United States Patent [19]

Brittain

[11] Patent Number: 4,666,648

[45] Date of Patent: May 19, 1987

[54] METHOD AND APPARATUS FOR MANUFACTURING ROOF TILES

[75] Inventor: David R. Brittain, Crowborough, England

[73] Assignee: Marley Tile AG, Zurich, Switzerland

[21] Appl. No.: 561,600

[22] PCT Filed: Apr. 8, 1983

[86] PCT No.: PCT/GB83/00105

§ 371 Date: Nov. 29, 1983

§ 102(e) Date: Nov. 29, 1983

[87] PCT Pub. No.: WO83/03632

PCT Pub. Date: Oct. 27, 1983

[30] Foreign Application Priority Data

Apr. 8, 1982 [GB] United Kingdom ..... 8210398

[51] Int. Cl.[4] ..... B28B 13/02; B28B 5/04; B28C 5/14

[52] U.S. Cl. ..... 264/145; 264/157; 264/333; 425/220; 425/296; 425/299; 425/304

[58] Field of Search ..... 264/151, 145, 333, 157; 425/220, 296, 299, 304, 218

[56] References Cited

U.S. PATENT DOCUMENTS

| | | | |
|---|---|---|---|
| 1,076,765 | 10/1913 | Hoffman | 425/218 |
| 1,204,477 | 11/1916 | Nicholson | 264/151 |
| 1,559,499 | 10/1925 | Brandell | 264/145 X |
| 1,577,935 | 3/1926 | Runkle . | |
| 1,619,489 | 3/1927 | Schwarz et al. . | |
| 2,734,249 | 2/1956 | Willis . | |
| 3,193,903 | 7/1965 | White | 425/220 X |

FOREIGN PATENT DOCUMENTS

| | | | |
|---|---|---|---|
| 2054041 | 8/1980 | Fed. Rep. of Germany | 52/620 |
| 370331 | 4/1932 | United Kingdom | 425/304 |
| 1577321 | 10/1980 | United Kingdom | 264/145 |

OTHER PUBLICATIONS

Sweets Architectural Catalog File, 1981, Section 7.7/MON, p. 2, Shake "400" series (tile at lower left).

*Primary Examiner*—Philip Anderson
*Attorney, Agent, or Firm*—Bacon & Thomas

[57] ABSTRACT

A roof tile (9) having contoured interlocking regions (20) along its side edges is provided with a plurality of relatively shallow closely spaced, longitudinally extending grooves on its upper surface (19) and optionally upwardly extending grooves on its lower end face (21). An improved appearance on a roof is obtained, and through the provision of dark brown streaks on a light brown base a roof tile may be given a wooden appearance. In a process and apparatus for the manufacture of such tiles, a slipper compressing tile forming material is provided with closely spaced ridges which form the grooves on the tiles.

15 Claims, 4 Drawing Figures

METHOD AND APPARATUS FOR MANUFACTURING ROOF TILES

This invention relates to roof tiles and in particular is concerned with a novel type of tile, and a process and apparatus for manufacturing the same.

Roof tiles are conventionally made of concrete and are produced in many colours and profiles. Such tiles are generally provided with contoured interlocking regions along their side edges whereby when laid on a roof each tile is laterally interlocked with the neighbouring tiles in the same row. Considerable effort has been expended on developing new colours and new profiles, e.g. with pronounced "rolls", to improve the visual appearance of the tiles. Nevertheless it has been found difficult, using e.g. concrete as a material, to simulate the appearance of other materials such as wood or slate. This is desirable if wishing to provide a concrete substitute, e.g. for wooden shingles. The use of contours is not significant in this regard, and indeed will be avoided if wishing to simulate wooden shingles for example. The use of colour techniques has not been found adequate.

Thus, viewed from one aspect the present invention provides a roof tile including contoured interlocking regions along its side edges and having over at least the major part of the upper surface thereof a plurality of relatively shallow closely spaced, longitudinally extending grooves.

The effect of the grooves will be to provide relatively closely spaced ridges and velleys across the upper surface of the tile. It has been found that this produces a visible effect superior to that obtainable with colouring techniques. Thus, the ridges and valleys can, when viewed from a distance, simulate e.g. the grain in wood in a manner which could not be achieved merely by streaks of colour. The addition of streaks of colour enhances the effect, however. A preferred tile therefore has the grooves together with random streaks of colour on its upper surface, such as streaks of dark brown to contrast with a light brown base. The streaks could be obtained for example using the method of U.K. Pat. No. 1,577,321 or by any other suitable method.

A further advantage of having ridges and valleys extending longitudinally down the tile is that they will promote the flow of rainwater down the tiles and inhibit flow across the tiles.

The appearance of the tile may be further enhanced by having upwardly extending grooves in the lower end face of the tile. The upper end face need not be so treated as it will not be visible in use. The appearance may also be enhanced by varying the lateral spacing between the grooves, preferably in a random manner. Thus between 3 and 12 grooves may for example be provided per inch. In combination with random colour streaking, this provides a particularly advantageous visual effect. The grooves are preferably no more than a quarter of an inch deep and this depth may vary e.g. randomly.

The tile will generally be made from concrete although other materials might be used. The tile can be manufactured by means of a modification of the conventional process and thus viewed from another aspect the invention provides a process for manufacturing roof tiles wherein tile forming material is discharged onto a succession of pallets to form a base ribbon, the ribbon is compressed by means of a slipper and is subsequently cut into individual tiles, wherein the tiles are provided over at least the major part of the upper surface thereof with a plurality of relatively shallow, closely spaced, longitudinally extending grooves by means of ridges provided on the slipper contacting the ribbon.

Apparatus in accordance with the invention may comprise means for transporting a succession of pallets in a longitudinal direction, means for discharging tile forming material onto the pallets to form a ribbon, a slipper for compressing the ribbon, and means for cutting the ribbon into individual tiles, wherein the slipper is provided over the major part of the surface thereof which contacts the ribbon with a plurality of relatively small, closely spaced, longitudinally extending ridges.

The means for cutting the ribbon into individual tiles, such as a guillotine or the like, may be shaped so as to form grooves in at least one end face of the tile. These grooves may be aligned with those in the upper surface and in any event may be of a similar spacing and depth.

Streaks of colouring may be provided by introducing a secondary, colouring material into a hopper or the like for the tile forming material, e.g. concrete mortar, at randomly timed intervals. Such processes are generally such that the streaks are formed mainly in the upper surface region of the tile. The action of the cutting means may cause the colouring to be pulled down the end face to add to the visual effect.

It will be appreciated that a significant advantage of the invention is that whilst an improved visual effect is obtained, and water control made possible, conventional techniques can be used with the exception that the slipper is modified in a simple yet effective manner.

The apparatus may include a roller, positioned before the slipper, to compress the tile forming material and this could also be provided with ridges corresponding to those on the slipper and, of course, preferably aligned therewith.

An embodiment of the invention will now be described by way of example and with reference to the accompanying drawings in which.

Figure 1:
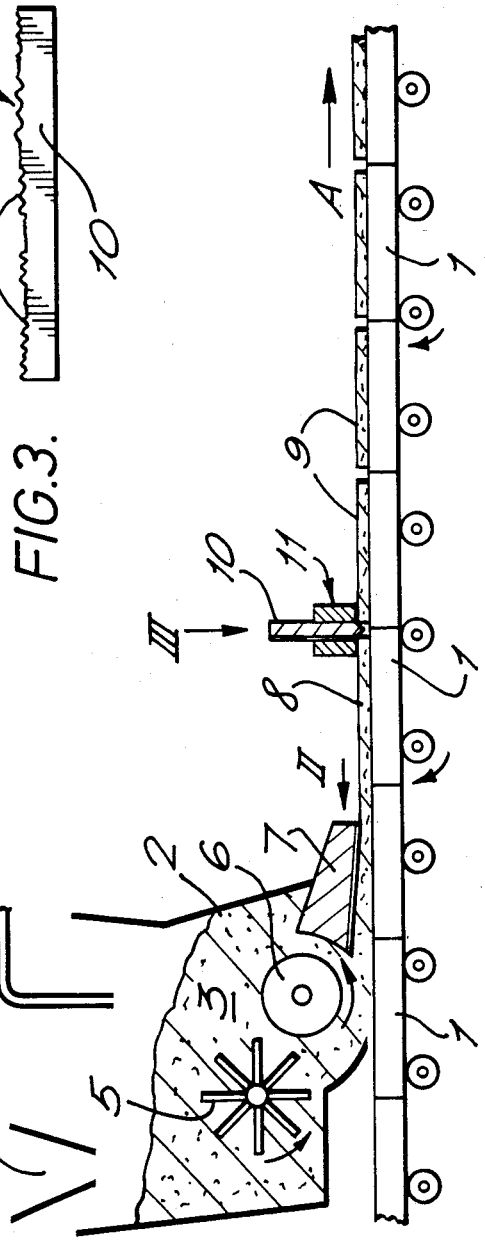
FIG. 1 is a diagrammatic view of apparatus in accordance with the invention.

Referring now to FIG. 1, tile forming apparatus consists of a plurality of pallets 1 linked together and driven in the direction of arrow A. A hopper 2 is supplied with concrete mortar 3 through a feed chute 4. Rotating paddles 5 urges the mortar towards a roller 6 which compresses the mortar down onto pallets 1. The mortar then passes under a slipper 7 which finally compresses the mortar and shapes the upper surface. The mortar emerges as a continuous ribbon 8 and is cut into individual tiles 9 by the blade 10 of a guillotine 11. A secondary colouring material is supplied to hopper 2 by means of a feed pipe 12 positioned over roller 6. The supply of colouring material is random and streaks of colour appear on the upper surface of the ribbon 8 and hence the tiles 9.

Figure 2:
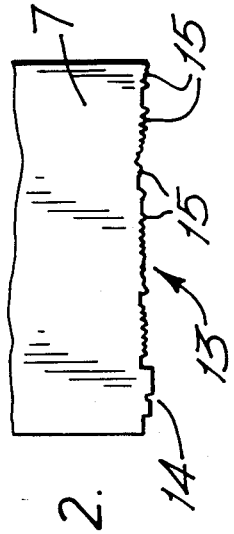
FIG. 2 is a view of part of the slipper in the direction of arrow II on FIG. 1.

As shown in FIG. 2, the slipper 7 has a bottom surface 13 which contacts the upper surface of the ribbon. This has substantial contours 14 to mould the interlocking region of the tile. In accordance with the invention however, the surface 13 is also provided with a series of relatively closely spaced, longitudinally extending parallel small ridges 15. These are positioned randomly across the slipper surface. The ridges are about a quarter of an inch high and vary in spacing between 3 and 12 per inch. They are exaggerated in size in FIG. 2. The tiles themselves can be of any required size, e.g. having standard widths of say 6½ or 13 inches. These small ridges produce corresponding shallow grooves in the upper surface of ribbon 8 and hance the eventual tiles 9.

Figure 3:
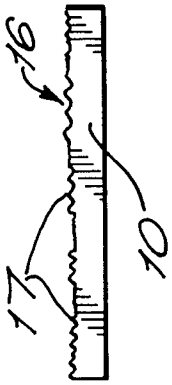
FIG. 3 is a view of part of the guillotine in the direction of arrow III on FIG. 1.

As shown in FIG. 3 the blade 10 of the guillotine 11 has its upstream face 16 provided with ridges 17. Thus as the tiles 9 are cut from ribbon 8 by blade 10, grooves are formed in one end face, being that which will face down the roof in use. At the same time, streaks of colour are pulled down the end face.

Figure 4:
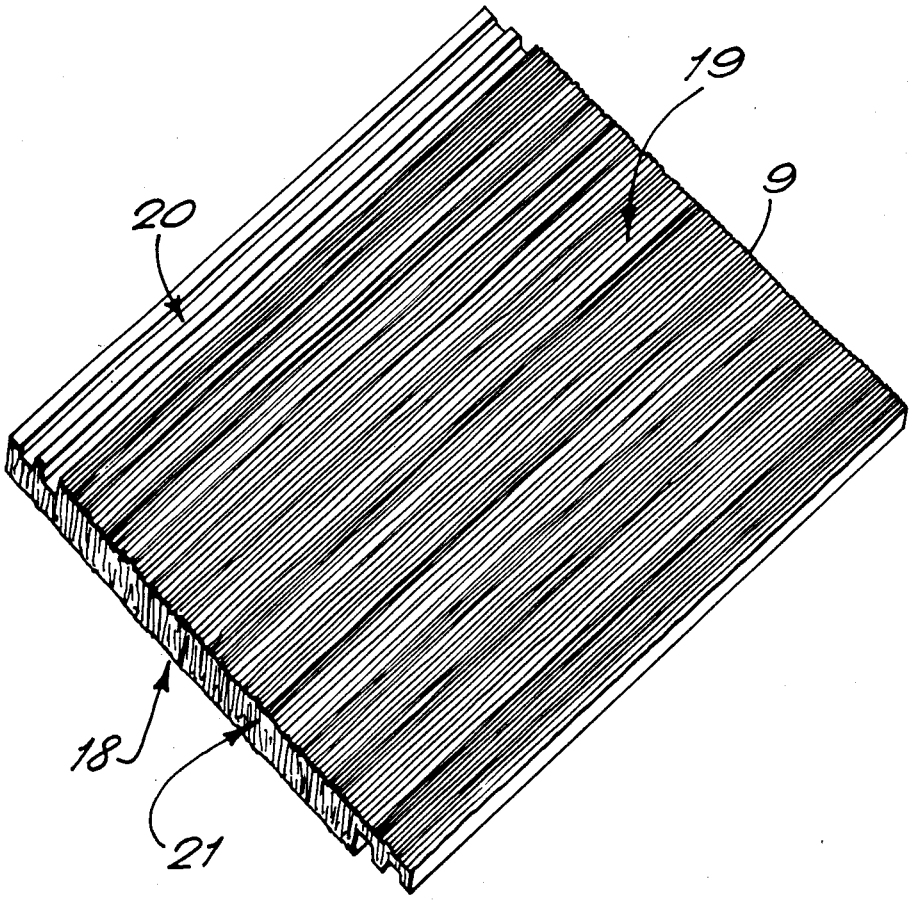
FIG. 4 is a perspective view of a tile in accordance with the invention.

Further handling of the tiles 9 is conventional. A finished tile is shown in FIG. 4. This has moulded contours on its bottom face 18, in accordance with the shape of pallets 1. The upper surface 19 is generally flat although it has an interlocking region 20 along one edge. Both the upper surface 19 and the lower end face 21 have grooves and streaks of colour thereon, produced in accordance with the invention. It has been found that dark brown streaks on a lighter brown background, in combination with the parallel grooves, provides a good simulation of wood grain.

What is claimed is:

1. A process for manufacturing roof tiles wherein tile forming material is discharged onto a succession of pallets to form a base ribbon, and the ribbon is compressed by means of a slipper and is subsequently cut into individual tiles, wherein the tiles are provided over at least a major part of the upper surface thereof with a plurality of relatively shallow, closely spaced, longitudinally extending grooves by means of ridges provided on the slipper contacting the ribbon.

2. A process as claimed in claim 1 wherein said longitudinally spaced grooves are spaced at between 3 and 12 grooves per inch.

3. A process for manufacturing roof tiles wherein tile forming material is discharged onto a succession of pallets to form a base ribbon, and the ribbon is compressed by means of a slipper and is subsequently cut into individual tiles, wherein the tiles are provided over at least a major part of the upper surface thereof with a plurality of relatively shallow, closely spaced, longitudinally extending grooves by means of ridges provided on the slipper contacting the ribbon, and wherein said cut forms closely spaced grooves on at least one surface edge of said tiles.

4. A process as claimed in claim 1 or 3 wherein colouring material is added to the tile forming material at randomly timed intervals.

5. A process as claimed in claim 1 or 3 wherein the plurality of relatively shallow, closely spaced, longitudinally extending grooves have a depth of about ¼ inch and are positioned randomly across the upper surface of the tile.

6. A process as claimed in claim 5 wherein the roof tile is an interlocking roof tile which has an interlocking molded contour on its bottom face and its upper surface is generally flat with an interlocking region along one edge and said roof tile simulates wooden shingles.

7. A process as claimed in claim 5, wherein said longitudinally spaced grooves are spaced at between 3 and 12 grooves per inch.

8. Apparatus for manufacturing roof tiles comprising means for transporting a succession of pallets in a longitudinal direction, means for discharging tile forming material onto the pallets to form a ribbon, a slipper for compressing the ribbon, and means for cutting the ribbon into individual tiles, wherein the slipper is provided over the major part of the surface thereof which contacts the ribbon with a plurality of relatively small, closely spaced, longitudinally extending ridges.

9. Apparatus for manufacturing roof tiles comprising means for transporting a succession of pallets in a longitudinal direction, means for discharging tile forming material onto the pallets to form a ribbon, a slipper for compressing the ribbon, and means for cutting the ribbon into individual tiles, wherein the slipper is provided over the major part of the surface thereof which contacts the ribbon with a plurality of relatively small, closely spaced, longitudinally extending ridges, and wherein said cutting means is shaped so as to form closely spaced grooves on at least one surface of the tile.

10. Apparatus as claimed in claim 6 or 9 further comprising a roller positioned before the slipper to compress the tile forming material which roller is provided with ridges corresponding to those on the slipper.

11. Apparatus as claimed in claim 10 wherein said ridges on said slipper are about ¼ inch high and are positioned randomly across the slipper surface.

12. Apparatus as claimed in claim 11, wherein said ridges are spaced at between 3 and 12 ridges per inch.

13. Apparatus as claimed in claim 8 or 9 wherein said ridges on said slipper are about ¼ inch high and are positioned randomly across the slipper face.

14. Apparatus as claimed in claim 8 or 9 wherein the pallets and slipper surfaces are formed so as to provide an interlocking tile with contours on its bottom face formed by said pallets and an upper surface which is generally flat with an interlocking region along one edge.

15. Apparatus as claimed in claim 8 or 9, wherein said ridges are spaced at between 3 and 12 ridges per inch.

* * * * *